US006385996B2

(12) United States Patent
Brugerolle

(10) Patent No.: US 6,385,996 B2
(45) Date of Patent: May 14, 2002

(54) PROCESS AND INSTALLATION FOR SEPARATION OF AIR BY CRYOGENIC DISTILLATION

(75) Inventor: Jean Renaud Brugerolle, Paris (FR)

(73) Assignee: L'Air Liquide, Societe Anonyme Aodirectoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/725,462

(22) Filed: Nov. 30, 2000

(30) Foreign Application Priority Data

Dec. 2, 1999 (FR) ..... 99 15208

(51) Int. Cl.[7] ..... F25J 3/00
(52) U.S. Cl. ..... 62/647; 62/924
(58) Field of Search ..... 62/643, 646, 900, 62/924, 647

(56) References Cited

U.S. PATENT DOCUMENTS 4,818,262 A 4/1989 Brugerolle
5,291,737 A 3/1994 Camberlein et al.
5,379,599 A 1/1995 Mostello
5,490,391 A * 2/1996 Hogg et al. ..... 62/643
5,551,258 A 9/1996 Rathbone
5,582,035 A * 12/1996 Rathbone et al. ..... 62/654
5,865,041 A 2/1999 Agrawal et al.
6,119,482 A * 9/2000 Bianchi et al. ..... 62/646
6,220,054 B1 * 4/2001 Rathbone ..... 62/644

FOREIGN PATENT DOCUMENTS

EP 0 430 803 6/1991
FR 2169561 9/1973

* cited by examiner

*Primary Examiner*—William C. Doerrler
(74) *Attorney, Agent, or Firm*—Young & Thompson

(57) ABSTRACT

In an apparatus for the separation of air by cryogenic distillation, the overhead gas of a mixing column is sent to the passages for warming a bottom reboiler of the low-pressure column of a double column fed with air to be distilled. The production of oxygen in the bottom of the low-pressure column is increased.

32 Claims, 3 Drawing Sheets

PROCESS AND INSTALLATION FOR SEPARATION OF AIR BY CRYOGENIC DISTILLATION

BACKGROUND OF INVENTION a) Field of the Invention

The invention relates to a process and a plant for the separation of air by cryogenic distillation. In particular, it relates to a process for producing pure oxygen using a mixing column and, possibly, for producing argon using an argon column.

b) Description of Prior Art

In EP-A-0229803, the mixing column is fed at the bottom with vaporized rich liquid coming from the head condenser of the argon column.

EP-A-0269342 relates to the case in which the argon column is thermally coupled to a mixing column so that the overhead gas of the argon column warms the mixing column.

U.S. Pat. No. 5,551,258 describes a process in which a mixing column is fed at the top with a liquid containing 55 vol % oxygen, the overhead gas of the mixing column then serving to warm the bottom condenser of the low-pressure column.

One object of the present invention is to increase the amount of pure gaseous oxygen (containing more than 99.5 mol % oxygen) which can be produced by a double air separation column.

SUMMARY OF THE INVENTION

One object of the invention is an air separation plant for producing an oxygen-rich fluid by cryogenic distillation, comprising:

- a double column comprising at least one medium-pressure column and a low-pressure column which includes a reboiler for vaporizing the liquid in the bottom of the low-pressure column;
- a mixing column;
- means for sending cooled and compressed air to the medium-pressure column;
- means for sending an oxygen-enriched liquid from the medium-pressure column to an injection point of the low-pressure column and means for sending a nitrogen-enriched liquid from the medium-pressure column to the low-pressure column;
- means for sending gas to the bottom of the mixing column;
- means for sending a second oxygen-enriched liquid from the low-pressure column to the top of the mixing column, this second liquid being less volatile than the gas feeding the bottom of the mixing column;
- means for withdrawing an oxygen-rich fluid from the low-pressure column;
- means for sending at least one portion of a gas, possibly the overhead gas, from the mixing column to passages for warming the reboiler, characterized in that it includes means for withdrawing the second liquid from the low-pressure column at a level at least 5 theoretical trays below the injection point of the low-pressure column, or possibly at least 10 theoretical trays below the injection point of the low-pressure column and/or about a third of the way up the low pressure column.

The apparatus may include an argon column or simply a vaporizer for vaporizing liquid form the bottom of the medium pressure column by heat exchange with a gas from the low pressure column.

Preferably it comprises means for withdrawing the second liquid at a level between the bottom of the low pressure column and the point of removal of the feed to the argon column or the point of removal of the gas sent from the low pressure column to the rich liquid vaporizer.

In this case, the mixing column may be fed at the bottom with any gas more volatile than the liquid oxygen sent to the top of the column.

Another object of the invention is an air separation plant for producing an oxygen-rich fluid and possibly an argon enriched fluid by cryogenic distillation, comprising:

- a double column comprising a medium-pressure column and a low-pressure column which includes a reboiler for vaporizing the liquid in the bottom of the low-pressure column;
- a condenser, possibly at the top of an argon column;
- a mixing column;
- means for sending cooled and compressed air at least to the medium-pressure column;
- means for sending a first oxygen-enriched liquid from the medium-pressure column to the condenser;
- means for withdrawing an argon-enriched gas from a first level of the low-pressure column and means for sending it to the condenser or to the argon column;
- means for sending an oxygen-enriched liquid from the medium-pressure column to at least one injection point of the low-pressure column and a nitrogen-enriched liquid from the medium-pressure column to the low-pressure column;
- means for vaporizing oxygen-enriched liquid in the condenser and means for sending at least one portion of the vapour and/or air to the bottom of the mixing column;
- means for sending a second oxygen-enriched liquid from the low-pressure column to the top of the mixing column, this second liquid being less volatile than the gas feeding the bottom of the mixing column;
- possibly means for withdrawing an argon-enriched fluid at the top of the argon column;
- means for withdrawing an oxygen-rich fluid from the low-pressure column and
- means for sending at least one portion of a gas, possibly the overhead gas, from the mixing column to passages for warming the reboiler.

Preferably the apparatus comprises means for withdrawing the second liquid is withdrawn from the low-pressure column at a level at least 5 theoretical trays below the point of injection or the lowermost point of injection at a level (still more preferably at least 10 theoretical trays below the point of injection or the lowermost point of injection) and/or about a third of the way up the low-pressure column.

According to other optional aspects:

- the overhead gas of the mixing column at least partially condenses in the reboiler and at least part of the condensate is sent to the low pressure column, preferbaly at a level above the first level;
- there are means for sending the liquid in the bottom of the argon column to the top of the mixing column;
- there are means for sending a bottom liquid and/or an intermediate liquid from the mixing column to the double column;
- there are at least 80, preferably at least 90, theoretical trays in the low-pressure column;

there are means for sending air or a gas from the medium-pressure column to other passages for warming the reboiler;

the apparatus includes a blowing turbine for sending air to the low pressure column or the mixing column;

the apparatus comprises means for withdrawing gaseous nitrogen from the medium-pressure column as a product.

Another object of the invention is a process for the separation of air by cryogenic distillation for producing oxygen with a double column comprising:

a medium-pressure column; and a low-pressure column which includes a reboiler for vaporizing the liquid in the bottom of the low-pressure column, comprising the steps of:

sending cooled and compressed air to the medium-pressure column;

sending an oxygen-enriched liquid and a nitrogen-enriched liquid from the medium-pressure column to the low-pressure column;

sending gas to the bottom of the mixing column;

sending a second oxygen-enriched liquid from the low-pressure column to the top of the mixing column, this second liquid being less volatile than the gas feeding the bottom of the mixing column;

withdrawing an oxygen-rich fluid from the low-pressure column;

sending at least one portion of a gas, possibly the overhead gas, from the mixing column to passages for warming the reboiler, characterized in that the second liquid contains less than 5 mol % nitrogen and/or the gas sent from the mixing column to the warming passages contains less than 15 mol % nitrogen.

Another object of the invention is a process for the separation of air by cryogenic distillation for producing oxygen and possibly argon with a double column comprising:

a medium-pressure column;

a low-pressure column which includes a reboiler for vaporizing the liquid in the bottom of the low-pressure column; and a condenser, optionally at the top of an argon column, and a mixing column, comprising the steps of:

sending cooled and compressed air to at least the medium-pressure column;

sending a first oxygen-enriched liquid from the medium-pressure column to the head condenser;

withdrawing an argon-enriched gas from a first level of the low-pressure column and sending it to the condenser or the argon column;

sending an oxygen enriched liquid and a nitrogen-enriched liquid from the medium-pressure column to the low-pressure column;

at least partially vaporizing oxygen-enriched liquid in the condenser and sending at least one portion of the vapour and/or air to the bottom of the mixing column;

sending a second oxygen-enriched liquid from the low-pressure column to the top of the mixing column, this second liquid being less volatile than the gas feeding the bottom of the mixing column;

possibly withdrawing an argon-enriched liquid from the top of the argon column;

withdrawing an oxygen-rich fluid from the low-pressure column;

sending at least one portion of a gas, possibly the overhead gas, from the mixing column to passages for warming the reboiler, characterized in that the second liquid contains less than 5 mol. % nitrogen and/or the gas sent from the mixing column to the warming passages contains less than 15 mol. % nitrogen.

According to other optional aspects:

the overhead gas of the mixing column at least partially condenses in the reboiler and the condensate is sent to the low pressure column, possibly at a level above the first level;

at least part of the liquid in the bottom of the argon column is sent to the top of the mixing column;

a bottom liquid and/or an intermediate liquid are sent from the mixing column to the double column;

a gas from the medium-pressure column or air at least partially condenses in other passages for warming the reboiler;

the overhead gas of the mixing column comprises 3 to 5 mol % nitrogen;

the overhead gas of the mixing column comprises at least 93 mol. %, possibly at least 95 mol. % oxygen;

the liquid sent to the top of the mixing column contains at least 98 mol % oxygen;

the pressure of the mixing column is at between 0,5 and 1 bar above the pressure of the low pressure column.

It will be understood that the overhead gas of the mixing column may be withdrawn from the top of the mixing column or at most five theoretical trays below the top of the mixing column.

BRIEF DESCRIPTION OF THE DRAWINGS

The invention will now be described in greater detail with reference to FIGS. 1–3 which diagrammatically illustrate plants according to the invention.

DESCRIPTION OR PREFERRED EMBODIMENTS

Figure 1:
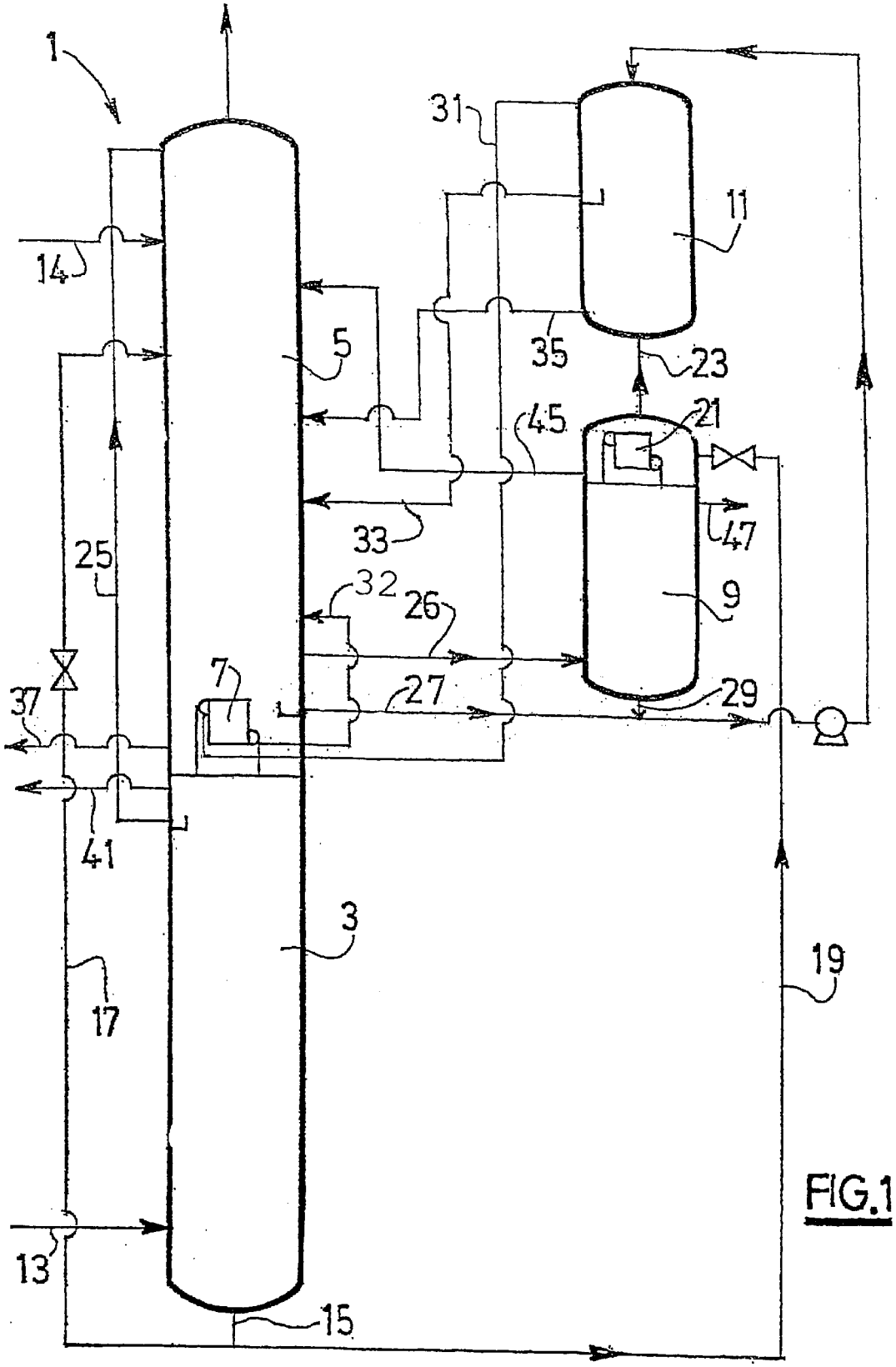

The plant in FIG. 1 comprises a double column 1 comprising a medium-pressure column 3 and a low-pressure column 5 coupled together via a reboiler 7.

The reboiler includes passages for vaporizing liquid and two independent series of warming passages for two different warming gases.

The low-pressure column operates at between 1.4 and 2.7 bar and the medium-pressure column operates at between 5 and 8 bar.

The argon column 9 is fed from a first level of the low-pressure column 5. There is also a mixing column 11 operating at a pressure between 1.9 and 3.7 bar.

A stream of air 13 is sent to the column 3 and a stream of blown air 14 is sent to the column 5.

A stream of liquid 15 containing 40 mol % oxygen is withdrawn from the bottom of the medium-pressure column 3; a portion 17 of this liquid feeds the low-pressure column 5 after expansion in a valve and a portion 19 of the liquid is expanded to between 1.7 and 2.2 bar absolute in a valve and sent to the head condenser 21 of the argon column 9 where it at least partially vaporizes. The vaporized liquid 23 is sent to the bottom of the mixing column.

The overhead nitrogen of the low-pressure column at least partially condenses in the bottom reboiler 7 and the condensate is sent to the medium-pressure column and/or the low-pressure column.

A gas stream 41 containing at least 80 mol % nitrogen is withdrawn as a product from the top of the medium-pressure column and constitutes 10 to 15% of the feed air.

A stream of nitrogen-enriched liquid 25 containing less than 2 mol % oxygen is sent from the medium-pressure column to the top of the low-pressure column.

A liquid stream 27 containing less than 5 mol % nitrogen is withdrawn from the bottom of the low-pressure column 5 below the point of withdrawal of the gas 26 intended for the argon column 9 and between 0 and 5 theoretical trays above the bottom of the column and is sent after pumping to between 1.9 and 3.7 bar to the top of the mixing column 11. Preferably, this stream 27 is mixed with the bottom liquid 29 of the argon column before being pumped and sent to the mixing column.

A gas stream 31 containing at most 5 mol % nitrogen is sent from the top of the mixing column to the reboiler 7 where it condenses in passages separate from those in which the nitrogen of the medium-pressure column condenses so as to increase the reflux in the bottom of the low-pressure column. Instead of this nitrogen, air or another fluid less volatile than the medium-pressure nitrogen may possibly be condensed therein, provided that it condenses in another condenser of the system, normally above the reboiler. A portion of the stream 31 may serve as an oxygen-enriched product.

Next, the liquid 32 containing 5 mol % nitrogen is sent to the low-pressure column at a level above the point of withdrawal of the stream 26.

An intermediate liquid 33 containing 80 mol % oxygen is sent from the mixing column to the low-pressure column 5.

The bottom liquid 35 containing 65 mol % oxygen is sent from the mixing column to the low-pressure column 5.

A stream 37 containing more than 99.5 mol % oxygen is withdrawn from the bottom of the low-pressure column 5 either in gaseous form or in liquid form.

It may thus be seen that the low-pressure column is fed, going from the top downwards, with lean liquid 25 containing less than 1 mol % oxygen, with blowing air 14, the unvaporized rich liquid 45 from the head condenser of the argon column, the rich liquid 17, the liquid 35 from the bottom of the mixing column, the intermediate liquid 33 from the mixing column and the recondensed mixture 32 from the reboiler 7.

In order to further improve the arrangement, several intermediate liquids could be sent from the mixing column to the low-pressure column.

The low-pressure column contains at least 80 theoretical trays and preferably at least 90 theoretical trays.

Figure 2:
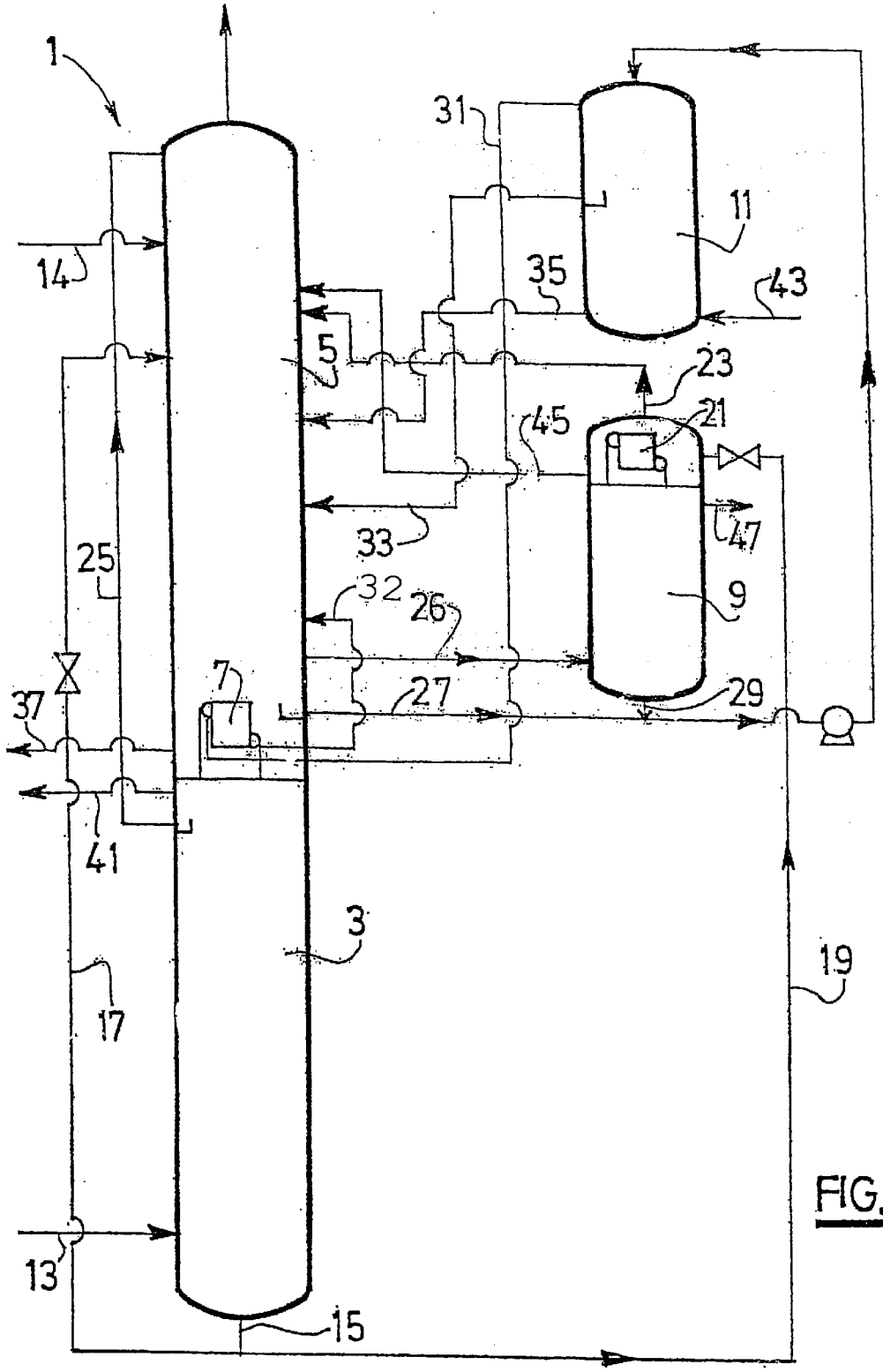

The plant in FIG. 2 differs from that in FIG. 1 in that the mixing column is fed at the bottom exclusively with a stream of air 43 possibly coming from a turbine or a supercharger (these not being illustrate). The vapour from the condenser 21 of the argon column is sent to the low-pressure column just below the point of injection of the rich liquid 45.

Figure 3:
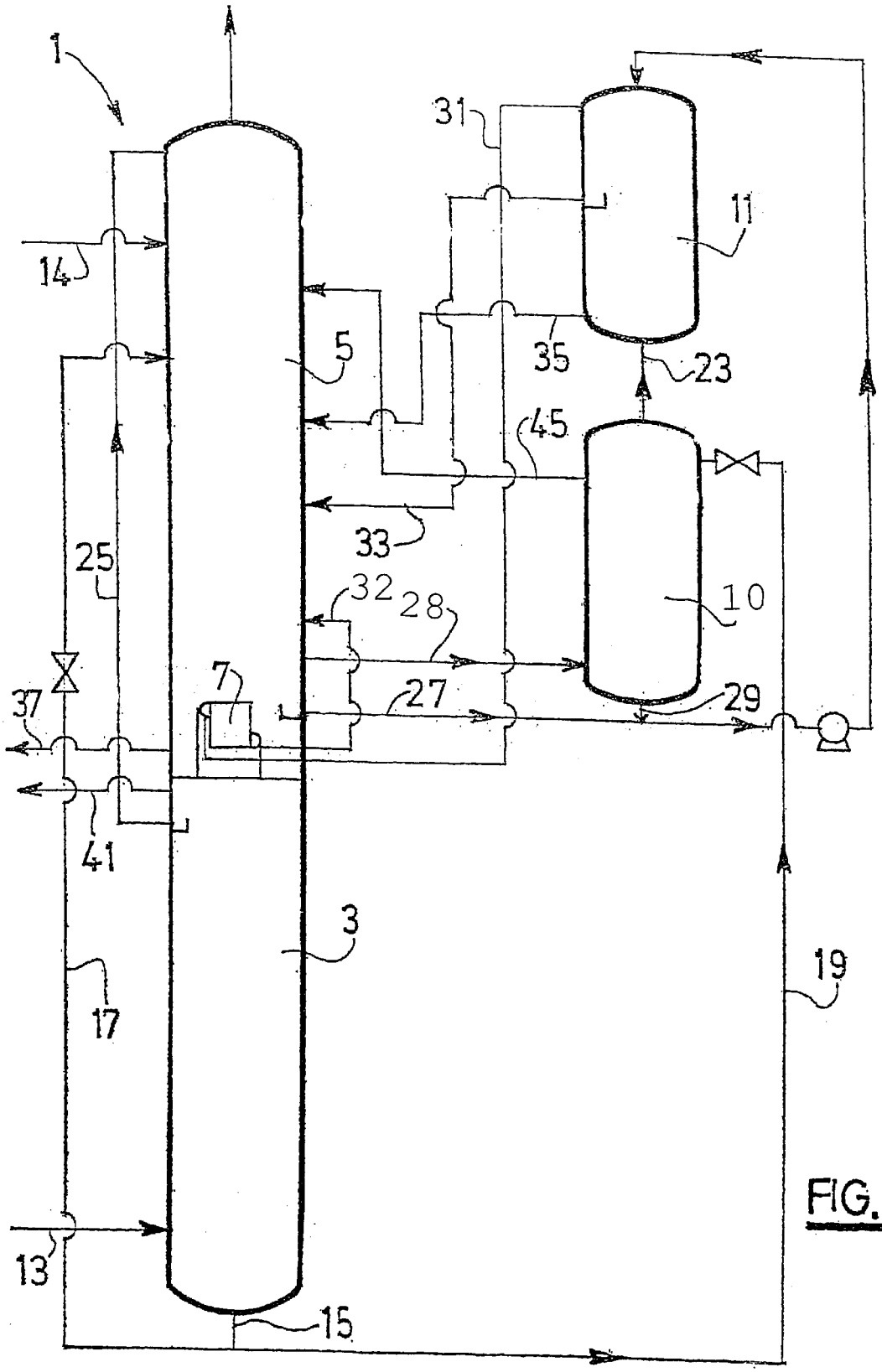

The plant in FIG. 3 differs from that in FIG. 1 in that the argon column is replaced by a condenser 10 heated by a gas 28 removed from the low-pressure column.

It would be conceivable to combine the concepts of FIGS. 1 and 2 and to feed the mixing column with air and with vaporized rich liquid at the same time.

Obviously in the case of FIG. 2, the argon column may be omitted or reduced to a simple condenser fed by rich liquid and a gas from the low pressure column, for example having the composition of the feed to the argon column.

As required, the argon column and/or the low-pressure column may be constructed in two sections in the manner described in EP-A-0628777.

Likewise, the medium-pressure and low-pressure columns may be constructed side by side.

These various staged feeds make it possible to obtain almost perfect low-pressure distillation. This allows the production of oxygen to be increased while maintaining, or even increasing, the production of argon when more than 10 to 15% of the air is withdrawn as medium-pressure nitrogen or 10 to 15% of the air is sent as blowing air.

The refrigeration needed for the apparatus may be provided by a blowing turbine and/or a Claude turbine and/or a nitrogen turbine. The apparatus may produce liquids and/or gases.

What is claimed is:

1. Air separation plant for producing an oxygen-rich fluid by cryogenic distillation, comprising:

a double column comprising at least one medium-pressure column and a low-pressure column which includes a reboiler for vaporizing liquid in the bottom of the low-pressure column;

a mixing column;

means for sending cooled and compressed air to at least the medium-pressure column;

means for sending an oxygen-enriched liquid from the medium-pressure column to an injection point of the low-pressure column and a nitrogen-enriched liquid from the medium-pressure column to the low-pressure column;

means for sending gas to the bottom of the mixing column;

means for sending a second oxygen-enriched liquid from the low-pressure column to the top of the mixing column, the second liquid being less volatile than the gas feeding the bottom of the mixing column;

means for withdrawing an oxygen-rich fluid from the low-pressure column;

means for sending at least one portion of a gas from the mixing column to passages for warming the reboiler, wherein the means for sending the second liquid further comprises means for withdrawing the second liquid from the low-pressure column at a level at least 5 theoretical trays below the injection point of the low-pressure column.

2. The plant according to claim 1, further comprising means for vaporizing at least part of a liquid withdrawn from the medium-pressure column and means for sending at least part of the vaporized liquid to the bottom of the mixing column.

3. The plant according to claim 1, further comprising means for sending a bottom liquid and/or an intermediate liquid from the mixing column to the double column.

4. The plant according to claim 1, further comprising at least 80 theoretical trays in the low-pressure column.

5. The plant according to claim 1, further comprising means for sending air, or a gas which contains more nitrogen than air from the medium-pressure column to other passages for warming the reboiler.

6. The plant according to claim 2, wherein the means for vaporizing at least part of a liquid withdrawn from the medium-pressure column comprises a top condenser of an argon column.

7. The plant according to claim 6, further comprising means for sending at least one portion of the liquid in the bottom of the argon column to the top of the mixing column.

8. The plant according to claim 2, wherein the means for vaporizing at least part of a liquid withdrawn from the medium-pressure column are constituted by a condenser heated by a gas removed from the low-pressure column.

9. The plant according to claim 8, wherein the means for sending the second liquid comprises means for withdrawing the second liquid at a level below the point of withdrawal of the gas heating the condenser.

10. Air separation plant for producing an oxygen-rich fluid and argon by cryogenic distillation, comprising:

a double column comprising a medium-pressure column and a low-pressure column which includes a reboiler for vaporizing liquid in the bottom of the low-pressure column;

an argon column comprising a condenser;

a mixing column;

means for sending cooled and compressed air to the medium-pressure column;

means for sending a first oxygen-enriched liquid from the medium-pressure column to the condenser;

means for withdrawing an argon-enriched gas from a first level of the low-pressure column and means for sending the argon-enriched gas to the argon column;

means for sending an oxygen-enriched liquid and a nitrogen-enriched liquid from the medium-pressure column to the low-pressure column;

means for at least partially vaporizing oxygen-enriched liquid in the condenser and means for sending at least one portion of the vapor and/or air to the bottom of the mixing column;

means for sending a second oxygen-enriched liquid from the low-pressure column to the top of the mixing column, the second liquid being less volatile than the gas feeding the bottom of the mixing column;

means for withdrawing an argon-enriched fluid at the top of the argon column;

means for withdrawing an oxygen-rich fluid at the low-pressure column; and means for sending at least one portion of a gas from the mixing column to passages for warming the reboiler.

11. The plant according to claim 10, further comprising means for withdrawing the second liquid at a level below the first level and above the bottom of the low-pressure column.

12. The plant according to claim 10, in which the gas of the mixing column at least partially condenses in the reboiler and the condensate is sent to a level above the first level.

13. A process for the separation of air by cryogenic distillation for producing oxygen with a double column comprising:

a medium-pressure column; and a low-pressure column which includes a reboiler for vaporizing liquid in the bottom of the low-pressure column, comprising the steps of:

sending cooled and compressed air to the medium-pressure column;

sending an oxygen-enriched liquid and a nitrogen-enriched liquid from the medium-pressure column to the low-pressure column;

sending gas to the bottom of the mixing column;

sending a second oxygen-enriched liquid from the low-pressure column to the top of the mixing column, the second liquid being less volatile than the gas feeding the bottom of the mixing column;

withdrawing an oxygen-rich fluid from the low-pressure column;

sending at least one portion of a gas from the mixing column to passages for warming the reboiler.

14. The process according to claim 13 in which the gas sent to the bottom of the mixing column is a vaporized liquid formed by removing oxygen enriched liquid from the medium-pressure column and vaporizing at least part of it.

15. The process according to claim 13 wherein the liquid is vaporized in the top condenser of an argon column.

16. The process of claim 13 wherein the liquid is vaporized in a condenser heated by a gas from the low-pressure column.

17. The process according to claim 13, wherein the gas from the mixing column at least partially condenses in the reboiler and the condensate is sent to the low-pressure column.

18. The process according to claim 15, further comprising the step of sending the liquid in the bottom of the argon column to the top of the mixing column.

19. The process according to claim 13, further comprising the step of sending a bottom liquid and an intermediate liquid from the mixing column to the double column.

20. The process according to claim 13, in which a gas from the medium-pressure column or air at least partially condenses in other passages for warming the reboiler.

21. The process according to claim 13, in which the gas from the mixing column comprises 1 to 7 mol % nitrogen.

22. The process according to claim 13, in which the gas from the mixing column comprises at least 93 mol % oxygen.

23. The process according to claim 13, in which the liquid sent to the top of the mixing column contains at least 99 mol % oxygen.

24. The process according to claim 13, in which air is sent to a blowing turbine and thence to the low pressure column or the column.

25. The process according to claim 13, in which gas is withdrawn as a product from the top of the medium-pressure column.

26. The process according to claim 13, in which the gas sent to the bottom of the mixing column is riches in oxygen than air.

27. The process according to claim 13 wherein the mixing column operates at a pressure between 0.5 and 1 bar above the pressure of the low-pressure column.

28. The process according to claim 13, wherein the second liquid contains less than 5 mol % nitrogen.

29. The process according to claim 13, wherein the gas sent from the mixing chamber to the warming passages contains less than 15 mol % nitrogen.

30. Process for the separation of air by cryogenic distillation for producing oxygen and optionally argon with a double column comprising:

a medium-pressure column;

a low-pressure column which includes a reboiler for vaporizing liquid in the bottom of the low-pressure column; and an argon column comprising a condenser and a mixing column, comprising the steps of:

sending cooled and compressed air to the medium-pressure column, sending a first oxygen-enriched liquid from the medium-pressure column to the condenser;

withdrawing an argon-enriched gas from a first level of the low-pressure column and sending the argon-enriched gas to the argon column;

sending an oxygen enriched liquid and a nitrogen-enriched liquid from the medium-pressure column to the low-pressure column;

at least partially vaporizing oxygen-enriched liquid in the condenser and sending at least one portion of the vapor and/or air to the bottom of the mixing column;

sending a second oxygen-enriched liquid from the low-pressure column to the top of the mixing column, the second liquid being less volatile than the gas feeding the bottom of the mixing column;

withdrawing an argon-enriched liquid from the top of the argon column;

withdrawing an argon-enriched liquid from the top of the argon column;

withdrawing an oxygen-rich fluid from the low-pressure column; and sending at least one portion of a gas from the mixing column to passages for warming the reboiler.

31. The process according to claim 30, wherein the second liquid contains less than 5 mol % nitrogen.

32. The process according to claim 30, wherein the gas sent from the mixing column to the warming passages contains less than 15 mol % nitrogen.

* * * * *